US011415010B1

(12) United States Patent
Chong et al.

(10) Patent No.: US 11,415,010 B1
(45) Date of Patent: Aug. 16, 2022

(54) TURBINE NOZZLE AND GAS TURBINE INCLUDING THE SAME

(71) Applicant: DOOSAN ENERBILITY CO., LTD., Changwon (KR)

(72) Inventors: Gene Chong, Jupiter, FL (US); Darryl Eng, Stuart, FL (US); IkSang Lee, Changwon (KR); JaeBin Lee, Changwon (KR); Hyunwoo Joo, Changwon (KR); Andres Jaramillo, Miami, FL (US); Kibaek Kim, Changwon (KR)

( * ) Notice: Subject to any disclaimer, the term of this patent is extended or adjusted under 35 U.S.C. 154(b) by 0 days.

(21) Appl. No.: 17/367,422

(22) Filed: Jul. 5, 2021

(51) Int. Cl.
*F01D 9/04* (2006.01)
*F01D 5/14* (2006.01)

(52) U.S. Cl.
CPC ..... *F01D 9/041* (2013.01); *F01D 5/141* (2013.01); *F01D 9/044* (2013.01); *F05D 2230/21* (2013.01); *F05D 2240/122* (2013.01); *F05D 2240/128* (2013.01); *F05D 2240/80* (2013.01)

(58) Field of Classification Search
CPC ..... F01D 9/041; F01D 9/044; F05D 2230/21; F05D 2240/122; F05D 2240/128; F05D 2240/80
See application file for complete search history.

(56) References Cited

U.S. PATENT DOCUMENTS 6,261,053 B1 * 7/2001 Anderson ..... F01D 25/12 415/115
6,672,832 B2 * 1/2004 Leeke ..... F01D 5/143 416/193 A
6,783,323 B2 * 8/2004 Shiozaki ..... F01D 5/18 415/115
7,134,842 B2 11/2006 Tam
7,195,454 B2 * 3/2007 Lu ..... F01D 11/005 415/181
7,220,100 B2 3/2007 Lee
8,439,643 B2 * 5/2013 Kuhne ..... F01D 5/20 416/193 A
8,647,067 B2 * 2/2014 Pandey ..... F01D 5/145 416/223 R
9,085,985 B2 7/2015 Barr
9,103,213 B2 * 8/2015 Barr ..... F01D 5/145
10,240,462 B2 * 3/2019 Venugopal ..... F01D 5/145
(Continued)

*Primary Examiner* — Igor Kershteyn
*Assistant Examiner* — Brian Christopher Delrue
(74) *Attorney, Agent, or Firm* — Harvest IP Law, LLP

(57) ABSTRACT

A gas turbine nozzle assembly of a gas turbine is provided. The turbine nozzle assembly may include a turbine nozzle extending from an inner platform to an outer platform and having an airfoil-shaped cross section having a leading edge and a trailing edge, and a pressure side and a suction side each of which extends from the leading edge to the trailing edge, wherein the turbine nozzle may include a plurality of vanes attached to the inner and outer platforms and the inner platform having an attached first and second endfaces and a flow surface surrounding opposing ends of a vane of the plurality of vanes, the flow surface terminating circumferentially at the first and second endfaces and terminating axially at forward and aft edges, and the inner platform may include a platform corner portion comprising the flow surface attached to the first endface at the forward edge and attached to the second endface at the aft edge.

20 Claims, 7 Drawing Sheets

(56) References Cited

U.S. PATENT DOCUMENTS

| | | | | |
|---|---|---|---|---|
| 2010/0166558 | A1* | 7/2010 | Siden | F01D 5/145<br>416/223 A |
| 2015/0337666 | A1* | 11/2015 | Xu | F01D 9/041<br>415/208.1 |
| 2016/0245104 | A1* | 8/2016 | Chakka | F01D 9/023 |

* cited by examiner

TURBINE NOZZLE AND GAS TURBINE INCLUDING THE SAME

TECHNICAL FIELD

This application relates to a turbine nozzle and more particularly to a gas turbine nozzle platform having an offset corner structure capable of optimizing and maintaining a gas path gap between the nozzle and adjoining bucket and gas turbine including the same.

BACKGROUND

Turbines are machines that obtain rotational force by impulsive force or reaction force using a flow of a compressible fluid such as steam or gas, and include a steam turbine using steam, a gas turbine using hot combustion gas, and so on.

The gas turbine includes a compressor, a combustor, and a turbine. The compressor includes an air inlet into which air is introduced, and a plurality of compressor vanes and a plurality of compressor blades which are alternately arranged in a compressor casing. The introduced air is compressed by the compressor vanes and the compressor blades while passing through the inside of the compressor.

The combustor supplies fuel to air compressed by the compressor and ignites a fuel-air mixture with an igniter to produce high-temperature and high-pressure combustion gas.

The turbine includes a plurality of turbine vanes and a plurality of turbine blades which are alternately arranged in a turbine casing. In addition, a rotor is arranged to pass through centers of the compressor, the combustor, the turbine, and an exhaust chamber.

The rotor is rotatably supported at both ends thereof by bearings. A plurality of disks is fixed to the rotor, and a plurality of blades are connected to each of the disks while a drive shaft of a generator is connected to an end of the exhaust chamber.

The gas turbine does not include a reciprocating mechanism, such as a piston, which is usually present in a typical four-stroke engine. Therefore, the gas turbine has no mutual fictional parts, such as a piston-cylinder part, thereby consuming an extremely small amount of lubricating oil and reducing an operational movement range, which results in high speed operability.

During the operation of the gas turbine, air is first compressed by a compressor and then the compressed air is mixed with fuel. Then, the fuel-air mixture is burned to produce high-temperature and high-pressure combustion gas, and the high-temperature and high-pressure combustion gas is ejected toward a turbine. The ejected combustion gas generates a rotational force by passing the turbine vanes and the turbine blades, thereby rotating the rotor.

There are various factors affecting the efficiency of the gas turbine. Recent development in the field of gas turbines has progressed in various aspects, such as improvement in combustion efficiency of the combustor, improvement in thermodynamic efficiency through the increase of a turbine inlet temperature, and improvement in aerodynamic efficiency of the compressor and the turbine.

When the high-temperature and high-pressure combustion gas is discharged to a turbine, a turbine nozzle exhibits a temperature variation of 1000 degrees or more throughout the regions thereof depending on whether the regions are directly exposed to the combustion gas. However, current engine components, such as platforms of the nozzle, may not be adequately designed to withstand such temperatures over time. Therefore, it is desirable to have an improved turbine nozzle including a platform design suitable for use in high operating temperatures. In addition, it is desirable for the improved turbine nozzle to be relatively simple and inexpensive to manufacture.

SUMMARY

Aspects of one or more exemplary embodiments provide a gas turbine nozzle assembly having a platform having an offset corner structure which may minimize aerodynamic contour changes and serve to optimize and maintain a gas path gap between the nozzle and adjoining bucket, thereby improving turbine performance and efficiency.

Additional aspects will be set forth in part in the description which follows and, in part, will become apparent from the description, or may be learned by practice of the exemplary embodiments.

According to an aspect of an exemplary embodiment, there is provided a turbine nozzle assembly including: a turbine nozzle extending from an inner platform to an outer platform and having an airfoil-shaped cross section having a leading edge and a trailing edge, and a pressure side and a suction side each of which extends from the leading edge to the trailing edge. The turbine nozzle including: a plurality of vanes attached to the inner and outer platforms; and the inner platform having an attached first and second endfaces and a flow surface surrounding opposing ends of a vane of the plurality of vanes, the flow surface terminating circumferentially at the first and second endfaces and terminating axially at forward and aft edges, wherein the inner platform may include a platform corner portion comprising the flow surface attached to the first endface at the forward edge and attached to the second endface at the aft edge.

The platform corner portion may include an offset flow surface by offsetting the platform corner portion, a radius of the flow surface being offset at a centerline of the platform of the turbine nozzle.

The offset may be about 0.070 inches.

The offset flow surface may terminate circumferentially at an approximate center of the platform corner portion.

The offset flow surface may be not tangent to the flow surface.

The turbine nozzle may have a constant fillet adjacent to the offset flow surface of the platform corner portion.

The platform corner portion may be formed by as-cast gas path offset.

The turbine nozzle may include at least one stress relief pocket defined within at least one of the inner and outer platforms, the at least one stress relief pocket facilitating reducing stress induced to the vane.

The at least one stress relief pocket may be defined proximate to the trailing edge.

The turbine nozzle assembly may include a turbine nozzle for a first stage turbine nozzle and a turbine nozzle for a second stage turbine nozzle.

According to an aspect of another exemplary embodiment, there is provided a gas turbine including: a compressor configured to compress air; a combustor configured to mix compressed air supplied from the compressor with fuel for combustion to generate combustion gas; and a turbine including a plurality of turbine nozzles and a plurality of turbine blades rotated by combustion gas to generate power, wherein each of the turbine nozzles extends from an inner platform to an outer platform and has an airfoil-shaped cross section having a leading edge and a trailing edge, and a pressure side and a suction side each of which extends from the leading edge to the trailing edge, and wherein the turbine nozzle including: a turbine nozzle assembly including: a plurality of vanes attached to the inner and outer platforms; and the inner platform having an attached first and second endfaces and a flow surface surrounding opposing ends of a vane of the plurality of vanes, the flow surface terminating circumferentially at the first and second endfaces and terminating axially at forward and aft edges, wherein the inner platform includes a platform corner portion comprising the flow surface attached to the first endface at the forward edge and attached to the second endface at the aft edge.

The platform corner portion may include an offset flow surface by offsetting the platform corner portion, a radius of the flow surface being offset at a centerline of the platform of the turbine nozzle.

The offset may be about 0.070 inches.

The offset flow surface may terminate circumferentially at an approximate center of the platform corner portion.

The offset flow surface may be not tangent to the flow surface.

The turbine nozzle may have a constant fillet adjacent to the offset flow surface of the platform corner portion.

The platform corner portion may be formed by as-cast gas path offset.

The turbine nozzle may include at least one stress relief pocket defined within at least one of the inner and outer platforms, the at least one stress relief pocket facilitating reducing stress induced to the vane.

The at least one stress relief pocket may be defined proximate to the trailing edge.

The turbine nozzle assembly may include a turbine nozzle for a first stage turbine nozzle and a turbine nozzle for a second stage turbine nozzle.

BRIEF DESCRIPTION OF THE DRAWINGS

The above and other aspects will become more apparent from the following description of the exemplary embodiments with reference to the accompanying drawings, in which.

DETAILED DESCRIPTION

Figure 1:
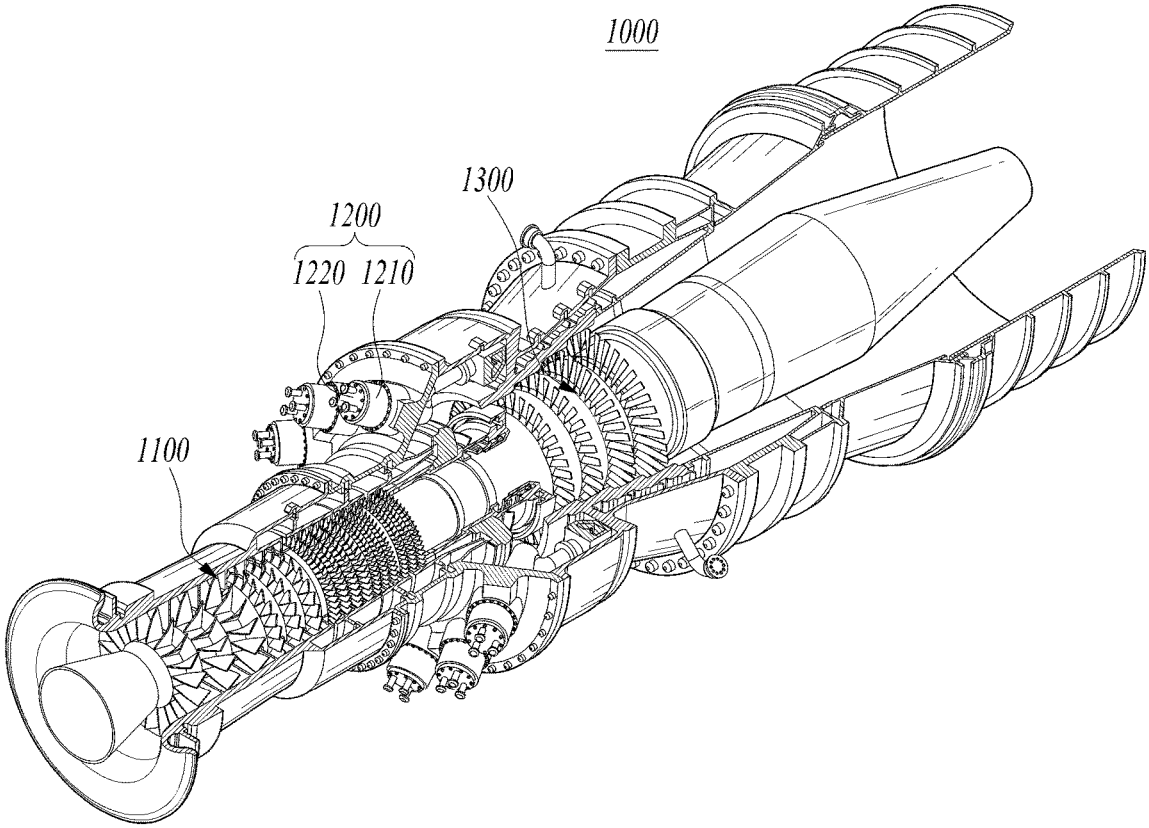
FIG. 1 is a partially cutaway perspective view illustrating a gas turbine according to an exemplary embodiment.

Various modifications and various embodiments will be described below in detail with reference to the accompanying drawings so that those skilled in the art can easily carry out the disclosure. It should be understood, however, that the various embodiments are not for limiting the scope of the disclosure to the specific embodiment, but they should be interpreted to include all modifications, equivalents, and alternatives of the embodiments included within the spirit and scope disclosed herein.

Hereinafter, exemplary embodiments will be described in detail with reference to the accompanying drawings. Throughout the disclosure, like reference numerals refer to like parts throughout the various figures and exemplary embodiments. In certain embodiments, a detailed description of functions and configurations well known in the art may be omitted to avoid obscuring appreciation of the disclosure by a person of ordinary skill in the art. For the same reason, some components may be exaggerated, omitted, or schematically illustrated in the accompanying drawings.

Figure 2:
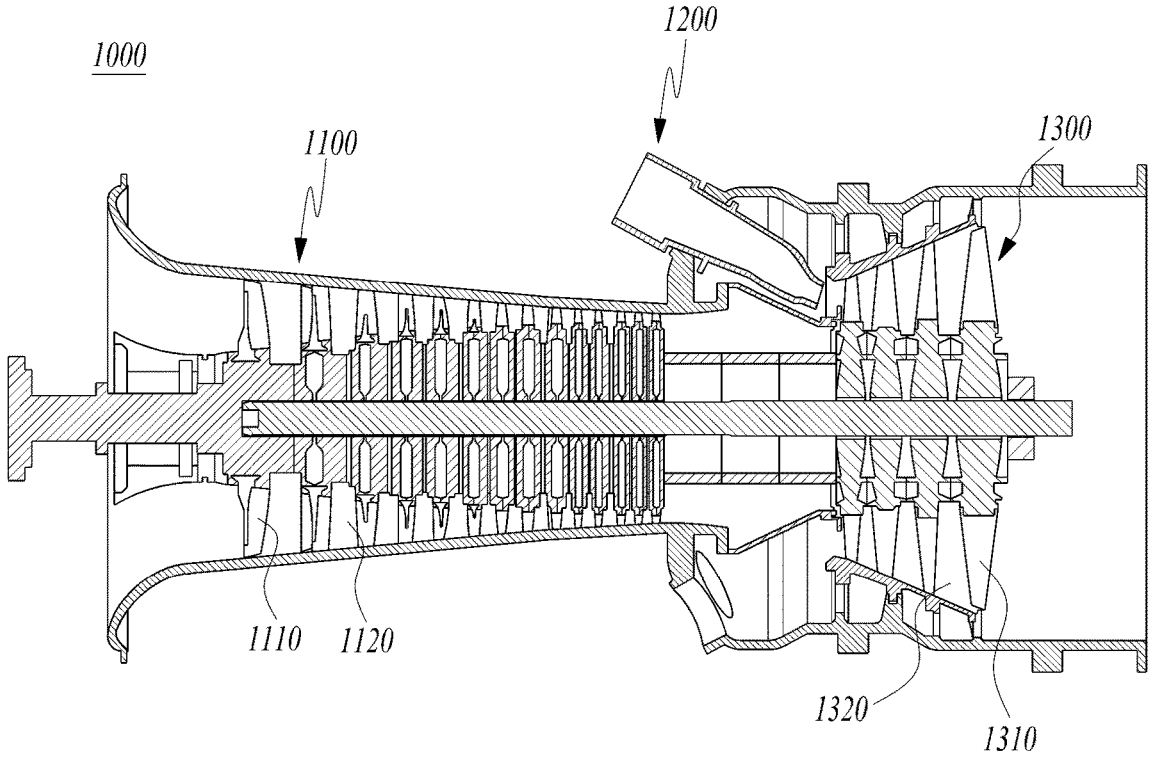
FIG. 2 is a cross-sectional view illustrating a schematic structure of the gas turbine according to the exemplary embodiment.

FIG. 1 is a partially cutaway perspective view illustrating a gas turbine according to an exemplary embodiment. FIG. 2 is a cross-sectional view illustrating a schematic structure of the gas turbine according to the exemplary embodiment.

Referring to FIGS. 1 and 2, the gas turbine 1000 may include a compressor 1100, a combustor 1200, and a turbine 1300. Based on a flow direction of gas (e.g., compressed air or combustion gas), the compressor 1100 is disposed at an upstream side of the gas turbine 1000, and the turbine 1300 is disposed at a downstream side of the gas turbine 1000. The combustor 1200 is disposed between the compressor 1100 and the turbine 1300.

The compressor 1100 includes compressor vanes 1120 and compressor rotors in a compressor housing. The turbine 1300 includes turbine vane 1320 and turbine rotors in a turbine housing. The compressor vanes 1120 and the compressor rotors are arranged in a multi-stage arrangement along the flow direction of compressed air. The turbine vanes 1320 and the turbine rotors are arranged in a multi-stage arrangement along the flow direction of combustion gas. The compressor 1100 is designed such that an internal space is gradually decreased in size from a front stage to a rear stage so that air drawn into the compressor 1100 can be compressed. On the other hand, the turbine 1300 is designed such that an internal space is gradually increased in size from a front stage to a rear stage so that combustion gas received from the combustor 1200 can expand.

A torque tube for transmitting a rotational torque generated by the turbine 1300 to the compressor 1100 is disposed between a compressor rotor that is located at the rearmost stage of the compressor 1100 and a turbine rotor that is located at the foremost stage of the turbine 1300. FIG. 2 illustrates a case in which the torque tube includes multiple torque tube disks arranged in a three-stage arrangement, but it is understood that this is only an example and other exemplary embodiments are not limited thereto. For example, the torque tube may include multiple torque tube disks arranged in an arrangement of equal to or greater than four stages or an arrangement of equal to or less than two stages.

Each of the compressor rotors includes a compressor rotor disk and a compressor blade 1110 fastened to the compressor rotor disk. That is, the compressor 1100 includes a plurality of compressor rotor disks, and respective compressor rotor disks are coupled to each other by a tie rod to prevent axial separation in an axial direction. The compressor rotor disks are arranged in the axial direction with the tie rod extending through centers of the compressor rotor disks. Adjacent compressor rotor disks are arranged such that opposing surfaces thereof are in tight contact with each other by being tightly fastened by the tie rod so that the adjacent compressor rotor disks cannot rotate relative to each other. Each of the compressor rotor disks has a plurality of compressor blades 1110 radially coupled to an outer circumferential surface thereof.

The compressor blades 1110 (also referred to as buckets) are radially coupled to an outer circumferential surface of each of the compressor rotor disks in a row. The compressor vanes 1120 (also referred to as nozzles) are provided on an inner circumferential surface of the compressor housing in an annular row in each stage, and rows of the compressor vanes 1120 are arranged between rows of the compressor blades 1110. While the compressor rotor disks rotate along with a rotation of the tie rod, the compressor vanes 1120 fixed to the housing do not rotate. The compressor vanes 1120 guide the flow of compressed air moved from front-stage compressor blades to rear-stage compressor blades.

The tie rod is disposed to pass through centers of the plurality of compressor rotor disks and turbine rotor disks. One end of the tie rod is fastened to a compressor disk located at the foremost stage of the compressor 1100, and the other end thereof is fastened in the torque tube by a fastening nut.

It is understood that the tie rod is not limited to the example illustrated in FIG. 2, and may be changed or varied according to one or more other exemplary embodiments. For example, a single tie rod may be disposed to pass through the centers of the rotor disks, a plurality of tie rods may be arranged circumferentially, or a combination thereof may be used.

Also, a deswirler (not shown) serving as a guide vane may be provided in the compressor 1100 to adjust an actual inflow angle of the fluid entering into an inlet of the combustor 1200 to a designed inflow angle.

The combustor 1200 mixes the introduced compressed air with fuel, burns a fuel-air mixture to produce high-temperature and high-pressure combustion gas with high energy, and increases the temperature of the combustion gas to a temperature at which the combustor and the turbine components are able to withstand an isobaric combustion process.

A plurality of combustors constituting the combustor 1200 of the gas turbine may be arranged in the housing in a form of a cell. Each combustor includes a burner having a fuel injection nozzle and the like, a combustor liner defining a combustion chamber, and a transition piece serving as a connector between the combustor and the turbine. The combustor 1200 may include a plurality of chambers 1210 and fuel nozzle modules 1220 arranged annually.

The high-temperature and high-pressure combustion gas supplied from the combustor 1200 flows into the turbine 1300 and expands while passing through the inside of the turbine 1300, thereby applying an impulsive force or reaction force to the turbine blades 1310 to generate a rotational torque. A portion of the rotational torque is transmitted to the compressor 1100 via the torque tube, and a remaining portion which is an excessive torque is used to drive a generator to produce power.

The turbine 1300 basically has a structure similar to the compressor 1100. That is, the turbine 1300 may include a plurality of turbine rotors similar to the compressor rotors, and each of the turbine rotor may include a turbine rotor disk and a turbine blade 1310 fastened to the turbine rotor disk. A plurality of turbine blades 1310 (also referred to as buckets) are radially disposed. A plurality of turbine vanes 1320 (also referred to as nozzles) are fixedly arranged on an inner circumferential surface of the turbine housing in an annular row in each stage, and rows of the turbine vanes 1320 are arranged between rows of the turbine blades 1310. The turbine vanes 1320 guide the flow direction of combustion gas passing through the turbine blades 1310.

Figure 3:
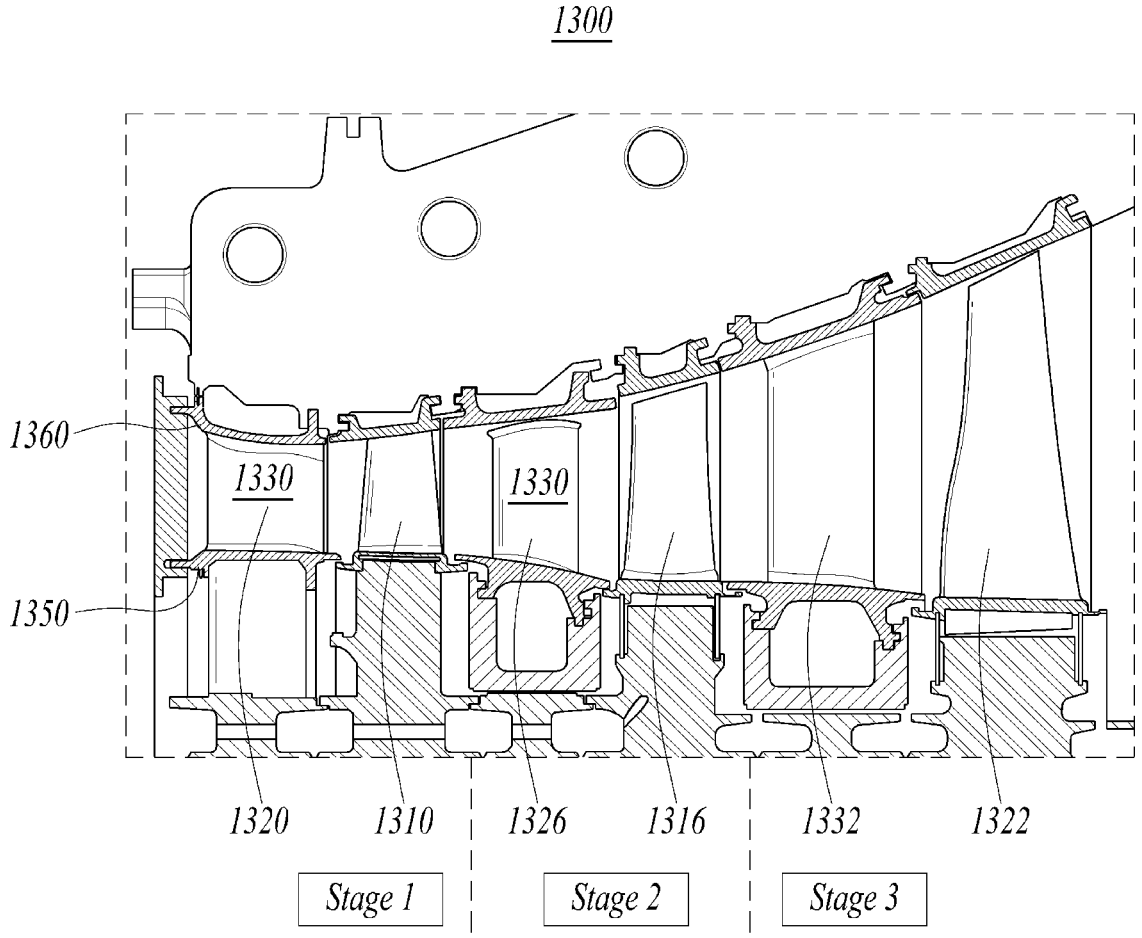
FIG. 3 is a partial sectional view illustrating an internal structure of the gas turbine according to an exemplary embodiment.

FIG. 3 is a partial sectional view illustrating an internal structure of the gas turbine according to an exemplary embodiment.

Referring to FIG. 3, the turbine 1300 may include a plurality of turbine stages employing a plurality of nozzles and a plurality of buckets. For example, the turbine may include a first stage having a first stage nozzle 1320 and a first stage bucket 1310, a second stage having a second stage nozzle 1326 and a second stage bucket 1316, and a third stage having a third stage nozzle 1332 and a third stage bucket 1322. Although FIG. 3 illustrates three turbine stages, this is only an example, and it is understood that any number of turbine stages may be used. Here, the first stage nozzle 1320 may include a vane 1330 having an inner platform 1350 and an outer platform 1360. The nozzle is axially symmetric about the axial centerline of the engine and includes a plurality of vanes 1330 integrally joined at radially opposite root ends to radially inner and outer platforms 1350 and 1360. For example, the turbine 1300 may include a plurality of first stage nozzles 1320 spaced, circumferentially, about a first stage nozzle assembly.

Figure 4:
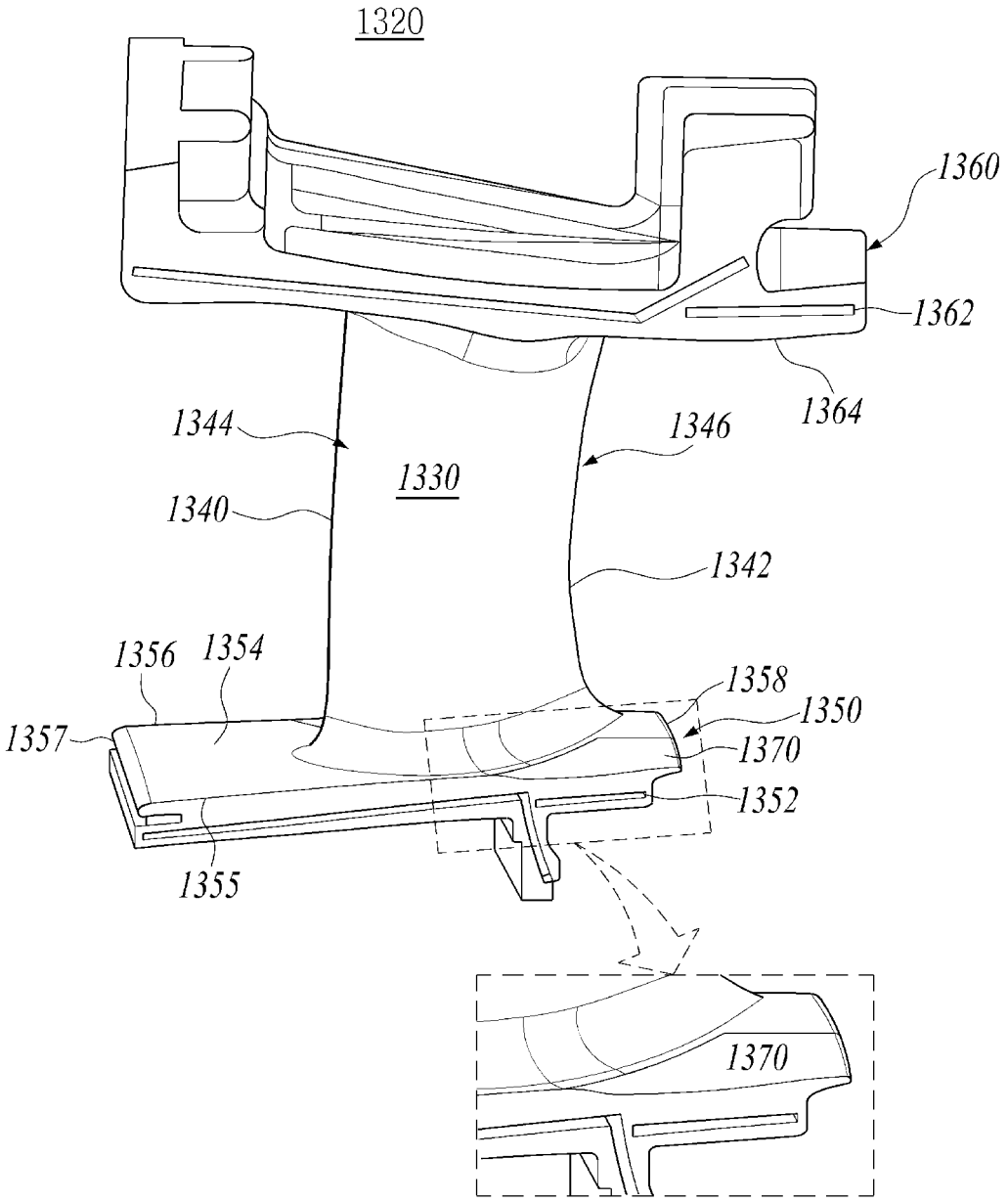
FIG. 4 is a perspective view of a turbine nozzle assembly of a first stage turbine nozzle according to an exemplary embodiment.
Figure 5:
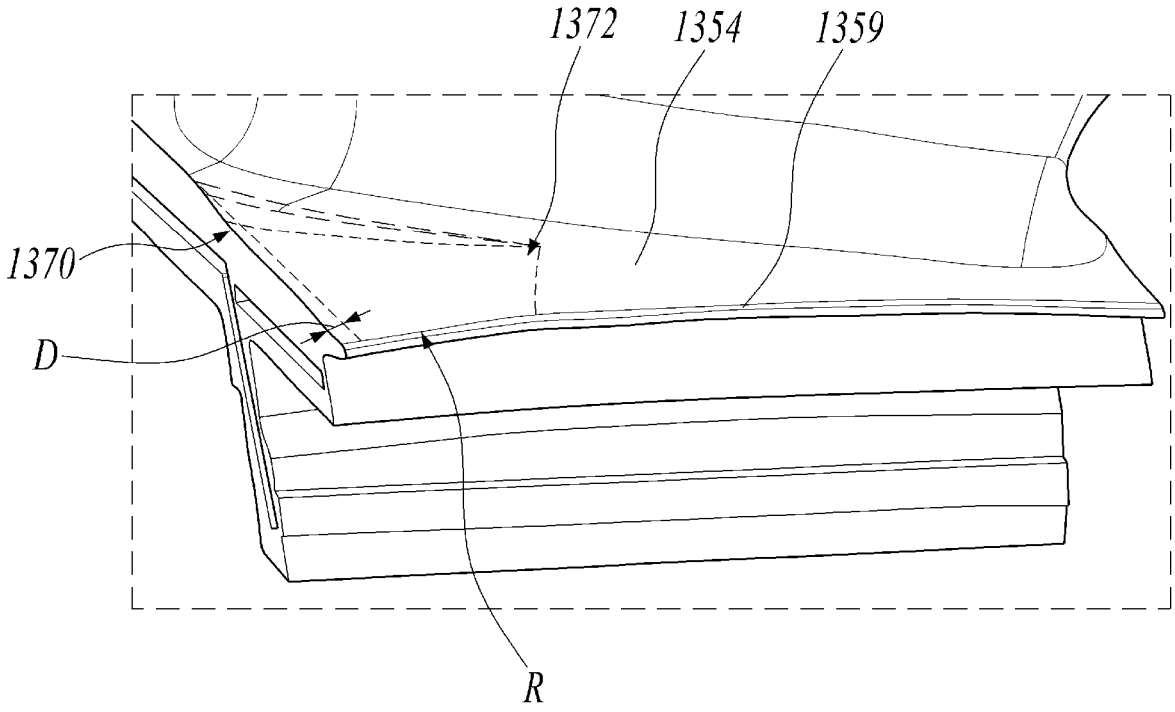
FIG. 5 is a cross-sectional view of a portion of the turbine nozzle assembly illustrated in FIG. 4.
Figure 6:
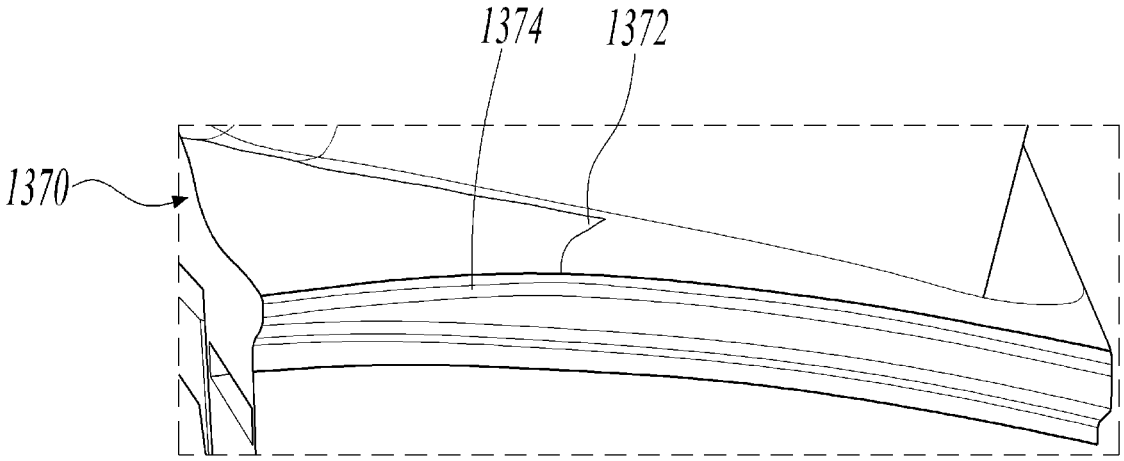
FIG. 6 is a cross-sectional view of a portion of the turbine nozzle assembly illustrated in FIG. 4.

FIG. 4 is a perspective view of a turbine nozzle assembly of a first stage turbine nozzle according to an exemplary embodiment. FIG. 5 is a cross-sectional view of a portion of the turbine nozzle assembly illustrated in FIG. 4. FIG. 6 is a cross-sectional view of a portion of the turbine nozzle assembly illustrated in FIG. 4.

Referring to FIG. 4, the turbine nozzle assembly 1320 according to the exemplary embodiment includes a turbine vane 1330 having an airfoil-shaped cross section and inner and outer platforms 1350 and 1360, respectively. The turbine vane 1330 extending from the inner platform 1350 to the outer platform 1360 includes a leading edge 1340, a trailing edge 1342, a pressure side 1344, and a suction side 1346. The pressure side 1344 and the suction side 1346 are formed to extend from the leading edge 1340 to the trailing edge 1342. For example, a front surface of the turbine vane 1330 onto which the combustion gas is introduced is formed with the suction side 1346, and a rear surface of the turbine vane 1330 is formed with the pressure side 1344. Here, the leading edge 1340 is disposed at an upstream side and the trailing edge 1342 is disposed at a downstream side with respect to a flow direction of the combustion gas. That is, the leading edge 1340 refers to a front end colliding with fluid flowing along the turbine vane 1330, and the trailing edge 1342 refers to a rear end of the turbine vane 1330. The pressure side 1344 is subjected to pressure due to the flowing fluid.

The inner platform 1350 includes a flow surface 1354 coupled to an interior of the turbine vane 1330 and a flange extending radially inward with respect to the center axis. For example, the flange extends radially inward from the inner platform 1350 with respect to radial flow surface 1354 of the inner platform 1350. The flow surface 1354 is formed in a substantially rectangular plate shape.

The outer platform 1360 includes a flow surface 1364 and a flange extending radially outward from the outer platform 1360 with respect to the flow surface 1364 of the outer platform 1360.

The inner and outer platforms 1350 and 1360 are positioned at opposite ends of the turbine vane 1330 to support the turbine vane 1330. The turbine nozzle assembly 1320 is constructed such that the inner platform 1350 is positioned toward the rotational axis of the gas turbine and the outer platform 1360 is positioned outward of the rotational axis of the gas turbine.

The turbine nozzle assembly 1320 includes a stress relief pocket 1362 within the flow surface 1364 of the outer platform 1360 and a stress relief pocket 1352 defined within the flow surface 1354 of the inner platform 1350. Here, the stress relief pockets 1362 and 1352 are openings defined within the flow surface 1364 of the outer platform 1360 and the flow surface 1354 of the inner platform 1350, respectively. For example, material forming flow surface 1364 of the outer platform 1360 is removed to form the stress relief pocket 1362. For example, the stress relief pocket 1362 may be formed using an electro-machining process such as electrical discharge machining. The stress relief pocket 1362 may also be formed within flow surface 1364 of the outer platform 1360 during a casting process or using a related art machining process. The stress relief pocket 1352 is formed in substantially the same manner as the stress relief pocket 1362. The stress relief pockets 1362 and 1352 may be formed within the flow surface 1364 of the outer platform 1360 and flow surface 1354 of the inner platform 1350, respectively, using any process that enables the turbine nozzle assembly 1320 to operate as described herein.

For example, the stress relief pockets 1362 and 1352 may extend any depth into the flow surface 1364 of the outer platform 1360 and flow surface 1354 of the inner platform 1350, respectively, that enable the stress relief pockets 1362 and 1352 to function as described herein. Also, it is understood that although illustrated as rectangular openings, the stress relief pockets 1362 and 1352 may include any shape or size that enable the stress relief pockets 1362 and 1352 to function as described herein. For example, a length, depth, and height of the stress relief pockets 1362 and 1352 may be optimized to maximize stress reduction while minimizing other impacts on the turbine nozzle assembly 1320.

Here, the stress relief pocket 1362 is defined within the outer platform 1360, proximate to the trailing edge 1342 of the turbine vane 1330. Similarly, the stress relief pocket 1352 is defined within the inner platform 1350, proximate to the trailing edge 1342 of the turbine vane 1330. That is, the stress relief pocket 1362 is defined outward from a tip of the turbine vane 1330 and the stress relief pocket 1352 is defined inward from a root of the turbine vane 1330.

The trailing edge 1342 is thinner than the leading edge 1340. The different amount of material present along the trailing edge 1342 compared to the leading edge 1340 causes temperature changes to affect the trailing edge 1342 differently than the leading edge 1340. The temperature changes that occur during engine startup and engine shutdown may cause stress on the turbine nozzle assembly 1320. The stress may include compressive stress and/or tensile stress. For example, during engine startup, as high-temperature and high-pressure combustion gas flows past the turbine vane 1330 that was previously at an ambient temperature, the trailing edge 1342 heats faster than the leading edge 1340. This heating causes a greater expansion of the trailing edge 1342 and therefore a greater compression occurs between the inner and outer platforms 1350 and 1360 at the trailing edge 1342 than between the inner and outer platforms 1350 and 1360 at the leading edge 1340. Conversely, during engine shutdown, the trailing edge 1342 cools more rapidly than the leading edge 1340. This cooling causes a greater contraction of the trailing edge 1342 and therefore a greater tension at the trailing edge 1342 than at the leading edge 1340. The stress relief pockets 1352 and 1362 facilitate increasing a flexibility of inner and outer platforms 1350 and 1360 at the trailing edge 1342, and thereby facilitate reducing a magnitude of both compressive and tensile portions of total stress.

For example, inboard surfaces of the inner and outer platforms 1350 and 1360 are precisely configured for maximizing aerodynamic performance of the turbine nozzle. Because the turbine nozzle vane has an airfoil configuration, the turbine nozzle vane turns or bends the combustion gas flow during the axial downstream passage between vanes. During operation, hot combustion gas generated in the combustor is discharged into corresponding flow paths between the circumferentially adjoining vanes. Each nozzle flow path converges from the leading edge of adjacent vane towards the trailing edge thereof. Because the inner and outer platforms 1350 and 1360 bound the combustion gas at radially opposite ends, the inner and outer platforms 1350 and 1360 are similar in configuration, with the inner platform 1350 being circumferentially convex radially outwardly, and the outer platform 1360 being circumferentially concave radially inwardly to conform with the annular configuration of the assembled bands mounted in the engine.

Referring to FIGS. 4 and 5, each of the inner and outer platforms 1350 and 1360 include corresponding flow surfaces 1354 and 1364 which surround the corresponding root ends of the vanes and face inboard toward each other to define the radially outer boundary of the vanes. In this way, the opposite flow surfaces 1354 and 1364 of the inner and outer platforms 1350 and 1360 confine the flow of the combustion gas over the individual vanes, with the corresponding sides of the vanes providing the lateral flow boundaries for the individual vanes. Because original flow surfaces 1354 and 1364 are constrained by the desired configuration of the vanes for maximizing turbine efficiency, it is undesirable to change the configuration or profile thereof. However, the flow surface 1354 may be tailored locally along the axial direction to reduce adverse aerodynamic and thermal consequences.

As illustrated in FIG. 4, the four sides or edges of the flow surface 1354 forms a general parallelogram in profile and conforms with the angular position of the turbine vane 1330 integrally formed therewith. The gas turbine nozzle includes a plurality of vanes 1330 attached to the inner and outer platforms 1350 and 1360. Each of the inner and outer platforms 1350 and 1360 includes first and second endfaces 1355 and 1356 and flow surfaces 1354 and 1364 surrounding opposite ends of the vanes to confine the flow of combustion gas between vanes. Here, the flow surface 1354 terminates circumferentially at first and second endfaces 1355 and 1356 and terminates axially at forward and aft edges 1357 and 1358.

For example, edges of the inner and outer platforms 1350 and 1360, particularly aft of the turbine vane 1330 are subject to severe thermal stresses. To minimize any thermal spike or trip of flow between the pressure side of the inner platform 1350 and the suction side of the adjacent inner platform 1350, a platform corner portion 1370 is formed on the flow surface 1354 of the inner platform 1350, as shown in FIGS. 4 and 5. The platform corner portion 1370 formed adjacent the trailing edge 1342 and along the suction side edge of the inner platform 1350 is slightly recessed below adjacent portions of the flow surface 1354 in the combustion gas path. Accordingly, the platform corner portion 1370, i.e., a trailing edge portion of the inner platform 1350, along the suction side is positioned at an elevation equal to or below the elevation of the edge along the pressure side of an adjacent inner platform 1350, thereby preventing thermal spikes along the suction side edge.

Referring to FIG. 5, the platform corner portion 1370 includes the flow surface 1354 attached to the first endface 1355 at the forward edge 1357 and attached to the second endface 1356 at the aft edge 1358. Here, a radius of the flow surface 1354 is offset at a platform centerline to form an offset flow surface 1372 of the platform corner portion 1370, and the offset flow surface 1372 terminates circumferentially at an approximate center of the platform corner portion 1370.

The turbine nozzle is initially manufactured by integrally casting the individual vanes 1330 with their corresponding inner and outer platforms 1350 and 1360 in unitary singlet assemblies, i.e., the turbine nozzle assembly 1320. The singlet assemblies are then joined together in the annular configuration of the resulting turbine nozzle. Each nozzle singlet assembly is subject to manufacturing tolerances of a few mils in the dimensions and positions of the various surfaces thereof including the flow surface 1354 which bounds the combustion gas radially inwardly at the inner platform 1350.

Here, the platform corner portion 1370 is introduced to extend in depth D below the flow surface 1354 of the inner platform 1350. As described above, the flow surface 1354 is initially designed for maximizing aerodynamic performance of the flow paths between the turbine vanes. Therefore, the profile and configuration of the flow surface 1354 is predefined. The flow surface 1354 is also designed for nominal placement in the installed nozzle assemblies for being flush from vane to vane around the circumference of the entire nozzle. Accordingly, without adversely affecting the intended nominal position of the flow surfaces 1354, the inner platform 1350 is locally modified to introduce the platform corner portion 1370 in depth D (i.e., an offset) only around the corresponding corner. The offset (i.e., the depth D) may be about 0.070 inches.

For example, the first endface 1355 and the aft edge 1358 in the inner platform 1350 each includes a major section 1359 which is devoid of the platform corner portion 1370, with the platform corner portion 1370 being located along only a corresponding minor portion of the endface 1355 and aft edge 1358. The major section 1359 illustrated in FIG. 5 extends from the platform corner portion 1370 continuously to the forward edge 1357 of the flow surface 1354 of the inner platform 1350 for substantially over the half length of the first endface 1355, including a middle section thereof, and extends from the platform corner portion 1370 continuously to the second endface 1356 of the flow surface 1354 of the inner platform 1350 for substantially over the half length of the aft edge 1358. In this configuration, the platform corner portion 1370 commences at the aft edge 1358 of the flow surface 1354 and terminates before reaching the middle of the first endface 1355 in the axial direction, and the platform corner portion 1370 commences at the first endface 1355 of the flow surface 1354 and terminates before reaching the middle of the aft edge 1358 in the circumferential direction. In this way, the flow surface 1354 of the inner platform 1350 may remain in nominal configuration and position as intended for maximizing aerodynamic performance of the turbine nozzle, with the platform corner portion 1370 being introduced locally along the first endface 1355 and the aft edge 1358 and terminating promptly as it approaches the middle of the flow surface 1354.

The actual size of the platform corner portion 1370 is controlled by the specific design of the turbine nozzle and the local direction of the combustion gas path. For example, the platform corner portion 1370 is deepest in depth near the edge point of the flow surface 1354, and decrease in depth before reaching the middle sections of axial direction and circumferential direction, and becomes the same as the adjacent portions. As illustrated in FIG. 5, the platform corner portion 1370 has an axial length along the corresponding endface 1355, which is less than about half of the axial length of the endface 1355 along the axial direction. Also, the platform corner portion 1370 has a circumferential length along the corresponding aft edge 1358, which is less than about half of the circumferential length of the aft edge 1358 along the circumferential direction. Therefore, the platform corner portion 1370 is relatively short and introduced in substantially minor portions of the axial and circumferential directions.

Here, the platform corner portion 1370 is recessed below the adjacent flow surfaces 1354 and provides an aerodynamically smooth transition therebetween. That is, the platform corner portion 1370 includes the offset flow surface 1372. The platform corner portion 1370 of the flow surfaces 1354 in the inner platform 1350 tapers smaller in size or radius R axially from the aft edges 1358 toward the forward edges 1357 and circumferentially from the first endface 1355 toward the second endface 1356. In other words, the radius R of the flow surfaces 1354 may be offset at the centerline of the platform to form the offset flow surface 1372 of the platform corner portion 1370. Further, the offset flow surface 1372 may terminate circumferentially at an approximate middle of the platform corner portion 1370. In addition, the offset flow surface 1372 of the platform corner portion 1370 is not tangent to the flow surface 1354.

Referring to FIG. 6, the turbine nozzle has a constant fillet 1374 adjacent to the offset flow surface 1372 of the platform corner portion 1370. Here, the fillet 1374 is constant because the gas path is offset to end towards the middle. In other words, the offset flow surface 1372 of the platform corner portion 1370 is offset until it ends in the middle, so the fillet 1374 is constant adjacent to the offset flow surface 1372.

Figure 7:
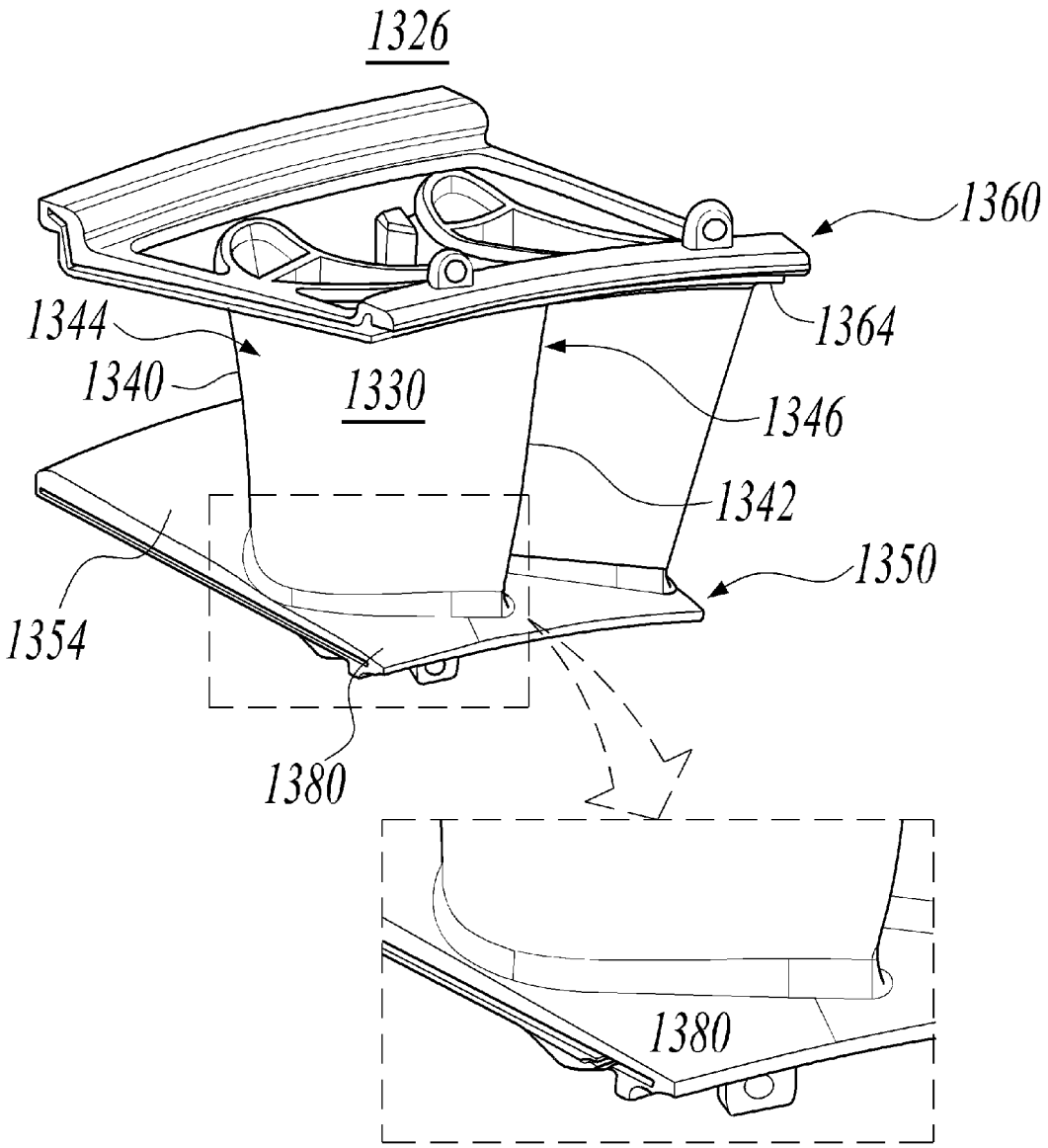
FIG. 7 is a perspective view of a turbine nozzle assembly of a second stage turbine nozzle according to an exemplary embodiment.

FIG. 7 is a perspective view of a turbine nozzle assembly of a second stage turbine nozzle according to an exemplary embodiment. Referring to FIG. 7, the turbine nozzle assembly 1326 according to the exemplary embodiment includes a turbine vane 1330 and inner and outer platforms 1350 and 1360, respectively. The turbine vane 1330 extending from the inner platform 1350 to the outer platform 1360 includes a leading edge 1340, a trailing edge 1342, a pressure side 1344, and a suction side 1346. The pressure side 1344 and the suction side 1346 are formed to extend from the leading edge 1340 to the trailing edge 1342.

For example, edges of the inner and outer platforms 1350 and 1360, particularly aft of the turbine vane 1330 are subject to severe thermal stresses. To minimize any thermal spike or trip of flow between the pressure side of the inner platform 1350 and the suction side of the adjacent inner platform 1350, a platform corner portion 1380 is formed on the flow surface 1354 of the inner platform 1350, as shown in FIG. 7. Here, because the platform corner portion 1380 of the second turbine nozzle assembly 1326 has the same structure as the platform corner portion 1370 of the first turbine nozzle assembly 1320 illustrated in FIGS. 4-6, a redundant description of the same configuration will be omitted.

The platform corner portions 1370 and 1380 according to the exemplary embodiments do not require removal of local portion of the inner platform 1350, because the offset flow surface 1372 of the platform corner portion 1370 is formed by as-cast gas path offset. That is, the turbine nozzle component according to the exemplary embodiments has the cast-in turbine nozzle platform. Therefore, according to the exemplary embodiments, the design of the turbine nozzle platform may minimize aerodynamic contour changes, thereby improving the turbine performance and efficiency.

While one or more exemplary embodiments have been described with reference to the accompanying drawings, it is to be understood by those skilled in the art that various modifications and changes in form and details can be made therein without departing from the spirit and scope as defined by the appended claims. Therefore, the description of the exemplary embodiments should be construed in a descriptive sense only and not to limit the scope of the claims, and many alternatives, modifications, and variations will be apparent to those skilled in the art.

What is claimed is:

1. A turbine nozzle assembly comprising:

a turbine nozzle extending from an inner platform to an outer platform and including a plurality of vanes attached to the inner and outer platforms and having an airfoil-shaped cross section having a leading edge and a trailing edge, and a pressure side and a suction side each of which extends from the leading edge to the trailing edge, wherein the turbine nozzle comprises:

the inner platform having an attached first and second endfaces and a flow surface surrounding opposing ends of a vane of the plurality of vanes, the flow surface terminating circumferentially at the first and second endfaces and terminating axially at forward and aft edges, wherein the inner platform includes a platform corner portion formed at a trailing edge portion of the inner platform along the suction side and comprising the flow surface attached to the first endface at the forward edge and attached to the second endface at the aft edge, wherein the platform corner portion includes an offset flow surface by offsetting only around the platform corner portion.

2. The turbine nozzle assembly according to claim 1, wherein a radius of the flow surface having a centerline at the axial center of the turbine nozzle is offset in the radial direction from the centerline to form the offset flow surface of the platform corner portion.

3. The turbine nozzle assembly according to claim 2, wherein the offset is 0.070 inches.

4. The turbine nozzle assembly according to claim 2, wherein the offset flow surface comprises a terminal portion that is circumferentially located furthest from the first endface, and the terminal portion terminates at an axial center of the platform corner portion.

5. The turbine nozzle assembly according to claim 2, wherein the offset flow surface is not tangent to the flow surface.

6. The turbine nozzle assembly according to claim 4, wherein the turbine nozzle has a fillet that is constant in that the fillet is continuously present adjacent to the offset flow surface of the platform corner portion.

7. The turbine nozzle assembly according to claim 1, wherein the platform corner portion is formed by a cast gas path offset.

8. The turbine nozzle assembly according to claim 1, wherein the turbine nozzle includes at least one stress relief pocket defined within at least one of the inner and outer platforms, the at least one stress relief pocket facilitating reducing stress induced to the vane.

9. The turbine nozzle assembly according to claim 8, wherein the at least one stress relief pocket is defined proximate to the trailing edge.

10. The turbine nozzle assembly according to claim 1, wherein the turbine nozzle assembly includes a turbine nozzle for a first stage turbine nozzle and a turbine nozzle for a second stage turbine nozzle.

11. A gas turbine comprising:

a compressor configured to compress air;

a combustor configured to mix compressed air supplied from the compressor with fuel for combustion to generate combustion gas; and a turbine comprising a plurality of turbine nozzles and a plurality of turbine blades rotated by the combustion gas to generate power, wherein each of the turbine nozzles extends from an inner platform to an outer platform and includes a plurality of vanes attached to the inner and outer platforms and has an airfoil-shaped cross section having a leading edge and a trailing edge, and a pressure side and a suction side each of which extends from the leading edge to the trailing edge, and wherein the turbine nozzle comprises:

the inner platform having an attached first and second endfaces and a flow surface surrounding opposing ends of a vane of the plurality of vanes, the flow surface terminating circumferentially at the first and second endfaces and terminating axially at forward and aft edges, wherein the inner platform includes a platform corner portion formed at a trailing edge portion of the inner platform along the suction side and comprising the flow surface attached to the first endface at the forward edge and attached to the second endface at the aft edge, wherein the platform corner portion includes an offset flow surface by offsetting only around the platform corner portion.

12. The gas turbine according to claim 11, wherein a radius of the flow surface having a centerline at the axial center of the turbine nozzle is offset in the radial direction from the centerline to form the offset flow surface of the platform corner portion.

13. The gas turbine according to claim 12, wherein the offset is 0.070 inches.

14. The gas turbine according to claim 12, wherein the offset flow surface comprises a terminal portion that is circumferentially located furthest from the first endface, and the terminal portion terminates at an axial center of the platform corner portion.

15. The gas turbine according to claim 12, wherein the offset flow surface is not tangent to the flow surface.

16. The gas turbine according to claim 14, wherein the turbine nozzle has a fillet that is constant in that the fillet is continuously present adjacent to the offset flow surface of the platform corner portion.

17. The gas turbine according to claim 11, wherein the platform corner portion is formed by a cast gas path offset.

18. The gas turbine according to claim 11, wherein the turbine nozzle includes at least one stress relief pocket defined within at least one of the inner and outer platforms, the at least one stress relief pocket facilitating reducing stress induced to the vane.

19. The gas turbine according to claim 18, wherein the at least one stress relief pocket is defined proximate to the trailing edge.

20. The gas turbine according to claim 11, wherein the turbine nozzle assembly includes a turbine nozzle for a first stage turbine nozzle and a turbine nozzle for a second stage turbine nozzle.

* * * * *